US005219235A

United States Patent [19]

Suematsu et al.

[11] Patent Number: 5,219,235

[45] Date of Patent: Jun. 15, 1993

[54] DOT LINE PRINTER HAVING IMPROVED YOKE ASSEMBLY

[75] Inventors: Shigenori Suematsu; Toshio Hiki; Yoshikane Matsumoto; Shinichi Sakamoto, all of Katsuta, Japan

[73] Assignee: Hitachi Koki Co., Ltd., Tokyo, Japan

[21] Appl. No.: 734,647

[22] Filed: Jul. 23, 1991

[30] Foreign Application Priority Data

Sep. 14, 1990 [JP] Japan ..... 2-245238
Mar. 18, 1991 [JP] Japan ..... 3-52350

[51] Int. Cl.[5] ..... B41J 2/245
[52] U.S. Cl. ..... 400/121; 101/93.04
[58] Field of Search ..... 181/93.04; 400/124, 400/121, 125

[56] References Cited

U.S. PATENT DOCUMENTS 4,502,382 3/1985 Kunita et al. ..... 101/93.04
4,625,638 12/1986 Fritz et al. ..... 101/93.04
4,879,947 11/1989 Kurosawa et al. ..... 101/93.04

*Primary Examiner*—Edgar S. Burr
*Assistant Examiner*—John S. Hilten
*Attorney, Agent, or Firm*—Sughrue, Mion, Zinn, Macpeak & Seas

[57] ABSTRACT

A printing hammer assembly is provided having a plurality of hammer springs arrayed side by side at a predetermined pitch in a shuttling direction of a hammer bank. A front yoke is provided in front of the hammer springs, and a plurality of rectangular grooves are formed at an upper portion of the front yoke so as to receive therein corresponding rectangular plungers provided at the hammer springs. A gap is defined between a side wall of the groove and a side wall of the plunger. The gap is sufficiently large for tolerating inaccurate assembly of the hammer springs and the front yokes. Further, a subordinate front yoke is provided on the front yoke at a position of an array of the grooves.

6 Claims, 2 Drawing Sheets

DOT LINE PRINTER HAVING IMPROVED YOKE ASSEMBLY

BACKGROUND OF THE INVENTION

The present invention relates to a dot line printer, and more particularly to a printing hammer assembly of the dot line printer capable of performing high speed printing. Throughout the specification and claims, the expression "front", "rear", "above", "below" and "laterally" are used herein to define the various parts when the print hammer assembly is disposed in an orientation in which it is intended to be used. For example, "front" implies a printing pin side, and "laterally" implies a direction of an array of a printing hammers.

A printing hammer assembly of a conventional dot line printer is shown in FIGS. 1 and 2. A comb yoke 18 is mounted on a base 14, and a permanent magnet 17 is interposed between the comb yoke 18 and the base 14. The comb yoke 18 has front surface defining a plurality of attraction surfaces having rectangular shape in cross-section. Further, an electromagnetic coil 19 is wound over a front portion, adjacent to a pole portion of the comb yoke 18. A leaf spring 11 has a base end fixed to a front face of the base 14 by a screw 16, and a front yoke 15 is positioned over the leaf spring 11, and is secured to the front face of the base 14 by the screw 16. The front yoke constitutes a part of a magnetic circuit. The leaf spring 11 has free end portion formed with a plurality of arm portions defining hammer springs arrayed side by side at a predetermined pitch in a lateral direction (shuttling direction of the hammer bank assembly). Each of printing pins 12 projects frontwardly from each of the arm portions of the leaf spring 11, and plungers 13 also protrude frontwardly from the arm portion at a position adjacent the printing pins. The arm and the printing pin constitute a printing hammer. The plungers 13 have cylindrical configuration, and corresponding bores are formed in the front yoke 15 to allow the plungers 13 to pass therethrough. Because of the magnetic force of the permanent magnet 17, rear faces of the plungers 13 are attracted to the pole portion provided at the front end portion of the comb yoke 18 with accompanying flex of the arm portions in order to maintain non-printing position of the pins. Further, because of the energization of the electromagnetic coil 19, the free end portion of the leaf spring are released from the pole portion to perform printing. Thus, spring-charged dot printing hammer is provided.

In order to perform high speed printing, two arrays of printing pins have been proposed. That is, the printing hammer assembly has an upper array of printing pins, and a lower array of printing pins, and totally 200 numbers or less of pins are provided with a pitch of the neighboring pins being 0.15 inches in order to print about 400 lines of Chinese characters per a minute. Further, if the printing speed is to be further enhanced to print about 600 lines of Chinese characters per minute, about 300 numbers of printing pins are required with the pin pitch of 0.1 inches. However, with high density arrangement of the printing pins, disadvantages may be caused.

SUMMARY OF THE INVENTION

As described above, the cylindrical plungers 13 are passed into the cylindrical bores formed in the front yoke 15. In this respect, if the pitch of the pins is reduced to 0.1 inches, small sized plungers are required.

Due to the reduction in size of the plunger, magnetic flux flowing through the plungers may be reduced, and therefore, sufficient magnetic attractive force cannot be provided.

To avoid this problem, there has been proposed a plunger having rectangular cross-section so as to coincide or resemble with the rectangular shape of the attraction surface of the comb yoke in order to enlarge the cross-sectional area of the plunger, to thereby increase the magnetic flux passing therethrough, the front yoke 15 being formed with rectangular grooves to allow the corresponding rectangular plungers to pass therethrough. Still however, since the width of the printing hammer in a direction of array of the printing hammers is extremely small, rigidity of the printing hammers in this direction becomes small. Therefore, the printing hammers may be deformed in that direction.

During operation of the above-described, densely arranged, printing hammers, magnetic imbalances may occur between neighboring plungers, and the printing hammers may be subjected to a load in the hammer array direction. Accordingly, printing pins 12 may be deviated from predetermined positions thereby affecting the dot impressing positions and degrading the printing image.

In summary, if a gap between the plunger 13 and the front yoke 15 is reduced for providing a large magnetic attraction force, the printing pins 12 may be deviated in the direction of array of the print hammers. Conversely, if such gaps are large, in an attempt to reduce the deviation of the printing pins, sufficient magnetic attractive force may not be provided. In other words, the requirement of avoiding the deviation of the printing pins is in direct conflict with the requirement of increasing the magnetic flux.

Thus, it is an object of the present invention to overcome the above described difficulties first acknowledged by the present inventors, and to provide an improved printing hammer assembly of a dot line printer in which sufficient magnetic flux can be provided while avoiding displacements of the printing pins in an array direction of print hammers.

Another object of the present invention is to provide a printing hammer assembly capable of providing sufficient print character images in spite of high speed printing and the above-described, densely arranged, printing hammers.

These and other objects of the present invention are attained by providing a printing hammer assembly which is reciprocable for printing a character line in a shutting direction and which has (a) a base having a front end surface, (b) a plurality of hammer springs arranged side by side at predetermined pitch in the shuttling direction, and having base ends secured to the front end surface of the base, and free ends provided with printing pins, (c) a plurality of plungers each having rectangular cross-section secured to the free ends of the hammer springs and positioned below the printing pins, (d) a permanent magnet mounted on the base for magnetically attracting the plungers to provide non-printing positions of the printing pins, (e) a rear yoke mounted on the base and having pole portions, (f) electromagnetic coils mounted on the pole portions for canceling magnetic force of the permanent magnet to provide a printing positions of the printing pins, (g) a front yoke positioned in front of the plurality of hammer springs and formed with a plurality of grooves arrayed side by side at the predetermined pitch corresponding to the plurality of plungers for allowing the plungers to be passed therethrough, corresponding grooves and plungers defining gaps therebetween larger than a predetermined level, and (h) a subordinate front yoke positioned in front of the grooves.

By the formation of the relatively large gap between the plungers and the grooves, lateral deviation of the printing pins due to the driving of the neighboring printing hammers can be reduced to a minimum level. Further, by the provision of the subordinate front yoke, sufficient magnetic force is obtainable in spite of the formation of the large gap.

DETAILED DESCRIPTION OF THE PREFERRED EMBODIMENT

Figure 1:
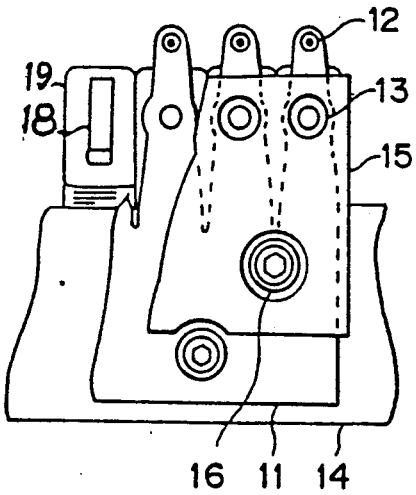
FIG. 1 PRIOR ART
FIG. 1 is a front view showing a conventional printing hammer assembly of a dot line printer.
Figure 2:
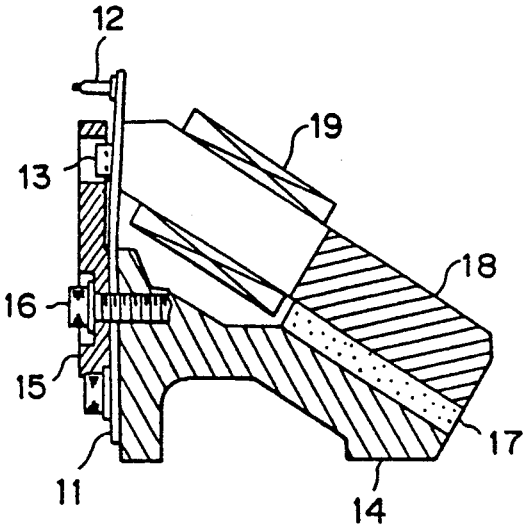
FIG. 2 PRIOR ART
FIG. 2 is a cross-sectional side view showing the conventional printing hammer assembly.
Figure 3:
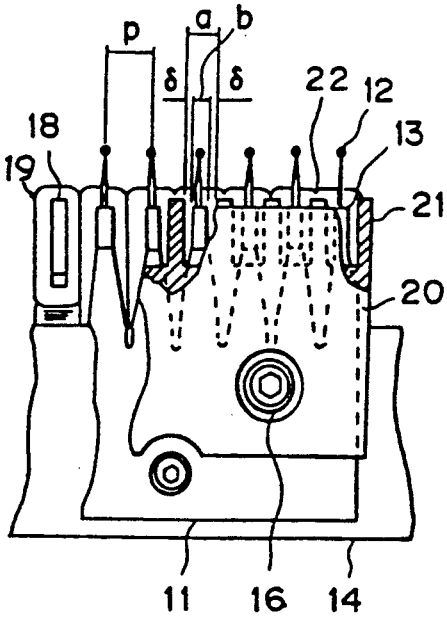
FIG. 3 is a front view showing a printing hammer assembly according to a first embodiment of this invention.
Figure 4:
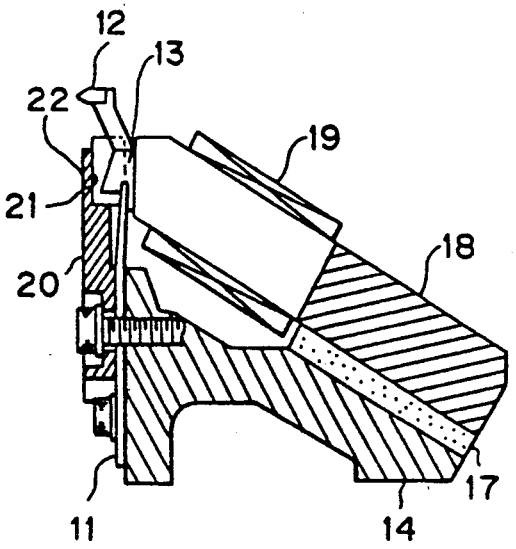
FIG. 4 is a cross-sectional side view showing the printing hammer assembly shown in FIG. 3.

A hammer bank assembly according to a first embodiment of this invention will be described with reference to FIGS. 3 and 4 wherein like parts and components are designated by the same reference numerals as those shown in FIGS. 1 and 2.

As described above, in order to conduct high speed printing, a pitch P of printing pins 12 is about 2.5 mm (0.1 inches). Each of plungers 13 provided on each arm portion of a leaf spring 11 has a rectangular shape at an attracted surface of the plunger. A width (b) of the plunger 13 is about 1.0 mm. At an upper portion of a front yoke 20, a plurality of rectangular grooves 21 are formed side by side at positions corresponding to the plungers 13 in a direction of array of the printing pins. Each of the grooves 21 has a width (a) of about 1.5 mm. Therefore, a gap δ provided between each side wall of the groove 21 and the plunger 13 becomes not less than 0.2 mm. That is, $$\delta=(a-b)/2=(1.5-1.0)/2=0.25$$

Thus, even by an inaccurate assembly of the hammer bank assembly, the gap of not less than 0.2 mm can be provided. Further, a subordinate front yoke 22 formed of a magnetic material is provided integrally with the front yoke 20 at a position in front of the rectangular grooves 21 in order to provide sufficient magnetic attractive force.

Figure 5:
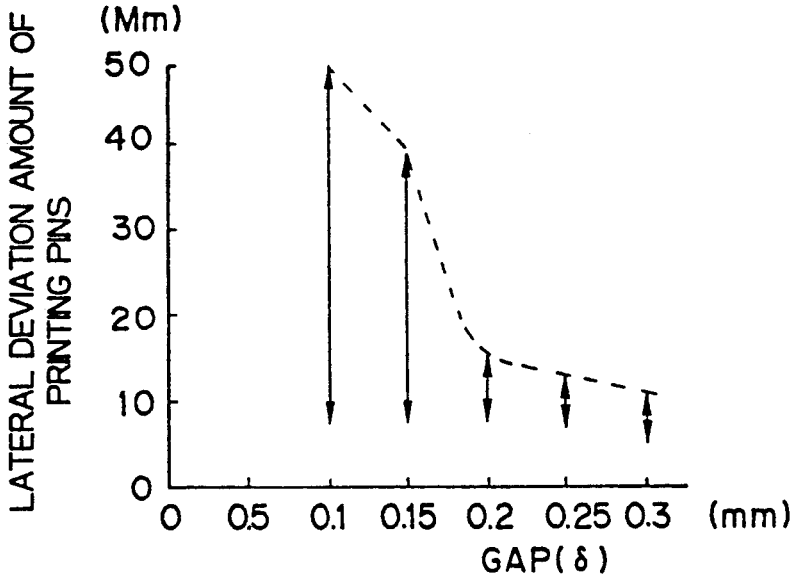
FIG. 5 is a graphical representation showing the relationship between a deviation distance of a printing pin and a gap δ between a plunger and a front yoke in a direction of array of printing hammers.

FIG. 5. shows a graphical representation showing the relationship between the deviation distance of a printing pin and a gap δ between a plunger and a front yoke in a direction of array of printing hammers. In the graph, vertically extending arrows show ranges of the deviation measured at each of the gaps. According to the graph, if the gap distance δ was 0.15 mm, a maximum lateral displacement amount of the printing pin 12 was 40 μm, and the lateral displacement became large, if the gap distance was more reduced. Such large displacement of the printing pins may affect printing quality, for example, the printed characters may be deformed or blurred. More specifically, in the graph if the gap distance δ of 0.15 mm was provided, the lateral displacement was in a range of from 7 to 40 μm. In the displacement, if the displacement exceeds 25 μm, printing quality was greatly affected. However, this displacement amount is not critical, since the printing quality is also dependent on other factors such as the displacement of the neighboring printing pins, and numbers of the printing pins in the pin array.

On the other hand, according to the graph, if the gap distance was not less than 0.2 mm, the lateral deviation of the printing pins was greatly reduced to about 15 μm or less.

The lateral displacement of the printing pins 12 is attributed to inaccurate positioning of the plungers 13 with respect to corresponding grooves 21 formed in the front yoke 20 during assembly. If no relative displacement occurs between the plungers and the grooves during assembling work of the hammer bank assembly, the lateral deviation of the printing pins can be minimized at low levels. However, in reality, perfect assembling work may not be attainable. Nevertheless, by providing a gap δ of not less than 0.2 mm, the lateral deviation of the printing pins can be reduced to 15 μm or less, as is apparent from the graph of FIG. 5. Because of such extremely small deviations of the printing pins 12, degradation of the printing is negligible.

Thus, in the first embodiment, the gap between the plunger 13 and the corresponding groove of the front yoke 20 is at least larger than a predetermined distance, such as in a range of 0.2 mm to 0.3 mm, so as to reduce lateral deviation of the printing pins 12, to thereby obviate degradation to the printing quality. Further, since the subordinate front yoke 22 is provided at the front yoke 20, sufficiently large magnetically attractive forces are obtainable despite the increase in the gap distance. Accordingly, a highly dense arrangement of the printing hammers results, to thus provide a high speed dot line printer.

Figure 6:
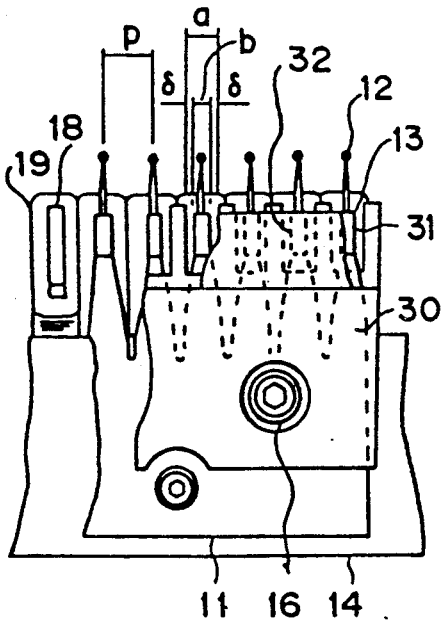
FIG. 6 is a front view showing a printing hammer assembly according to a second embodiment of this invention.

Next, a hammer bank assembly according to a second embodiment will be described with reference to FIGS. 6 and 7. In the first embodiment, the subordinate front yoke 22 is provided integrally with the front yoke 20. However, the integral arrangement may cause difficulty in manufacture. Therefore, in the second embodiment, a subordinate front yoke 32 is manufactured independent of the manufacture of a front yoke 30. More specifically, similar to the first embodiment, a plurality of rectangular grooves 31 are formed at an upper portion of the front yoke 30. Further, a front stepped portion **30*a* is formed at a front portion of the front yoke 30 so as to mount an elongated rectangular subordinate front yoke 32 on the stepped portion. This subordinate front yoke 32 can be stationarily held on the front yoke 30 because of the magnetic force of the permanent magnet 17. Alternatively, any fixing means such as adhesive material (not shown) is available for fixing the subordinate front yoke 32 to the front yoke 30. With the arrangement, as described above manufacture of the front yoke 30 and the subordinate front yoke 32** is facilitated, to thereby provide a hammer bank assembly at low cost.

Figure 7:
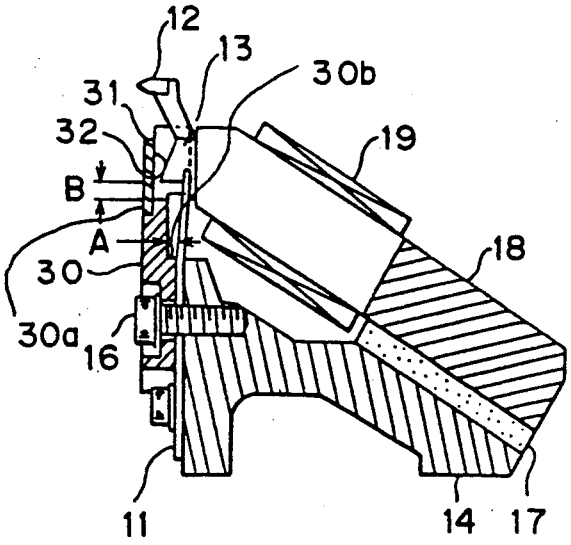
FIG. 7 is a cross-sectional side view showing the printing hammer assembly shown in FIG. 6.

Further, as best shown in FIG. 7, a relatively deep rear stepped portion 30*b* is provided in the front yoke 30 so as to provide a relatively large space A between a rear surface of the front yoke 30 and a front surface of the leaf spring 11. Further, provided is a relatively large distance B between a lower surface of the plunger 13 and a bottom surface of the groove 31 of the front yoke 30. With these large gaps A and B, initial bending of the leaf spring 11 can be controllable when the subordinate front yoke 32 is detached from the front yoke 30. In other words, even if the leaf spring 11 is further forcibly bent leftwardly in FIG. 7, the leaf spring 11 and the plunger 13 do not abut the front yoke 30 because of the formation of the large gaps A and B. Therefore, the amount of initial bending of the leaf spring 11 can be controlled in a wide range.

As described above, according to the present invention, the lateral deviation amount of the printing pins due to a driving operation of the neighboring printing hammers can be reduced to a minimum level by setting a relatively large gap between the grooves of the front yoke and the plungers. Further, since the subordinate front yoke is provided, sufficient magnetic force can be provided in spite of the formation of the large gap. Accordingly, the resulting print hammer assembly can provide a high density array of print hammers for high speed printing.

While the invention has been described in detail and with reference to specific embodiments thereof, it would be apparent to those skilled in the art that various changes and modifications may be made therein without departing from the spirit and scope of the invention.

What is claimed is:

1. A printing hammer assembly, which is reciprocable for printing a character line in a shuttling direction, comprising:

a base having a front end surface;

a plurality of hammer springs arranged side by side at a predetermined pitch in the shuttling direction, and having base ends secured to the front end surface of the base, and free ends provided with printing pins;

a plurality of plungers each having a rectangular cross-section and each secured, respectively, to the free ends of the hammer springs and positioned, respectively, below the printing pins;

a permanent magnet mounted on the base for magnetically attracting the plungers to provide non-printing positions of the printing pins;

a rear yoke mounted on the base and having pole portions;

electromagnetic coils mounted on the pole portions for canceling the magnetic force of the permanent magnet to provide printing positions of the printing pins;

a front yoke positioned in front of the plurality of hammer springs and formed with a plurality of grooves arrayed side by side at a predetermined pitch corresponding to the plurality of plungers for allowing the plungers to be passed therethrough, corresponding grooves and plungers defining gaps therebetween, said gaps ranging in width from approximately 0.2 mm to approximately 0.3 mm, to minimize magnetic interference between adjacent hammer springs thereby reducing lateral deviation of the hammer springs; and a subordinate front yoke formed from a magnetic material and positioned in front of and covering the grooves for maintaining a sufficiently large magnetic force of attraction between the corresponding grooves and plungers.

2. The printing hammer assembly as claimed in claim 1, wherein the subordinate front yoke is provided integrally with the front yoke.

3. The printing hammer assembly as claimed in claim 1, wherein the front yoke has a front end portion formed with a stepped portion, a separate subordinate front yoke being mounted on the stepped portion.

4. The printing hammer assembly as claimed in claim 3, wherein the subordinate front yoke is fixed to the stepped portion by a magnetic force of the permanent magnet.

5. The printing hammer assembly as claimed in claim 3, wherein the front yoke has a rear portion formed with a second step for providing a sufficiently large gap between a rear surface of the front yoke and a front surface of the hammer springs.

6. The printing hammer assembly as claimed in claim 5, wherein the plungers have lower surfaces, and the grooves have groove bottom faces, relatively large spaces being provided between each lower surface and each groove bottom face.

* * * * *